United States Patent [19]

Breslau

[11] 4,180,192

[45] Dec. 25, 1979

[54] STORAGE AND DISPENSING DEVICE FOR FILM CARTRIDGES OR THE LIKE

[75] Inventor: Steven M. Breslau, Cranford, N.J.

[73] Assignee: Pace Photographic Products, Inc., Union, N.J.

[21] Appl. No.: 909,379

[22] Filed: May 25, 1978

[51] Int. Cl.[2] ..... B65D 42/20; B65D 83/38

[52] U.S. Cl. ..... 224/235; 206/316; 221/185; 221/281; 224/196; 312/45

[58] Field of Search ..... 221/65, 66, 185, 186, 221/190, 281, 282, 286, 287, 306; 312/45, 72; 224/5 R, 5 D, 5 V, 15, 16, 26 R, 196, 235; 150/52 J; 206/3, 316, 535–537

[56] References Cited

U.S. PATENT DOCUMENTS

| | | | |
|---|---|---|---|
| 1,505,884 | 8/1924 | Goldquist | 150/52 J |
| 1,829,093 | 10/1931 | Hollins | 224/5 D X |
| 2,487,740 | 11/1949 | Stevens | 221/186 X |
| 3,269,597 | 8/1966 | Passavanti | 221/186 |
| 3,927,809 | 12/1975 | Klein | 206/316 X |
| 3,968,902 | 7/1976 | Bachmann | 206/537 X |

*Primary Examiner*—F. J. Bartuska

*Attorney, Agent, or Firm*—Lackenbach, Lilling & Siegel

[57] ABSTRACT

A film storage and dispensing device wherein an upright magazine contains a stack of film rolls or cartridges, the magazine having an upper inlet and lower outlet for gravitational discharge, and a cover slidable on the magazine for selectively opening and closing the inlet and outlet.

8 Claims, 7 Drawing Figures

7
35
31
13
15
11
16
30
19
33
31
43
59
58
57
56
20
10
22
18
40
12
25
26

3
21
13
17
15
42
28
20
43
10
33
59
58
57
56
50
49
19
11
55
41
12
27
16
4
60

2
13
12
40
11
59
58
57
56
20
43
10
19
55
41

STORAGE AND DISPENSING DEVICE FOR FILM CARTRIDGES OR THE LIKE

BACKGROUND OF THE INVENTION

As is well known to those versed in the photographic arts, the convenient carrying of fresh and used film has not heretofore been satisfactorily proposed. Rather, such film is generally carried in pockets or a cluttered gadget bag, creating problems in finding, as well as identifying exposed and unexposed film, and providing repeated obstacles to the searching for other items in pockets, gadget bags, and the like.

While prior film carriers have been proposed, such prior devices have been unduly complex, expensive, subject to malfunction, and have not found wide acceptance among users.

SUMMARY OF THE INVENTION

It is, therefore, an important object of the present invention to provide an entirely unique and highly improved film storage and dispensing device which overcomes the abovementioned difficulties and cures the problems of the prior art, serving to retain a supply of fresh film conveniently on the person of a user, without occupying pocket or gadget bag space, wherein by simply clicking open the dispenser a fresh roll may be conveniently removed and/or an exposed roll may be inserted into the dispenser, in a manner to permit repeated fresh film removal and exposed film insertion without possibility of mistaken identity or confusion.

It is another object of the present invention to provide a film storage and dispensing device of the type described which is extremely simple in construction for resultant durability and reliability in use and operation, and considerable savings in cost for distribution and sale at a reasonable price.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 3:
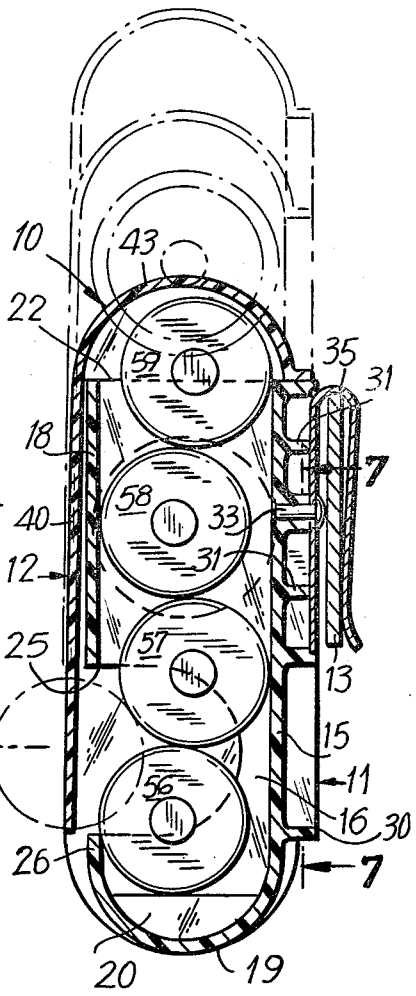
FIG. 3 is a sectional elevational view taken generally along the line 3—3 of FIG. 2, showing in phantom both the fully open and an intermediate open position, and illustrating a film roll being removed.
Figure 2:
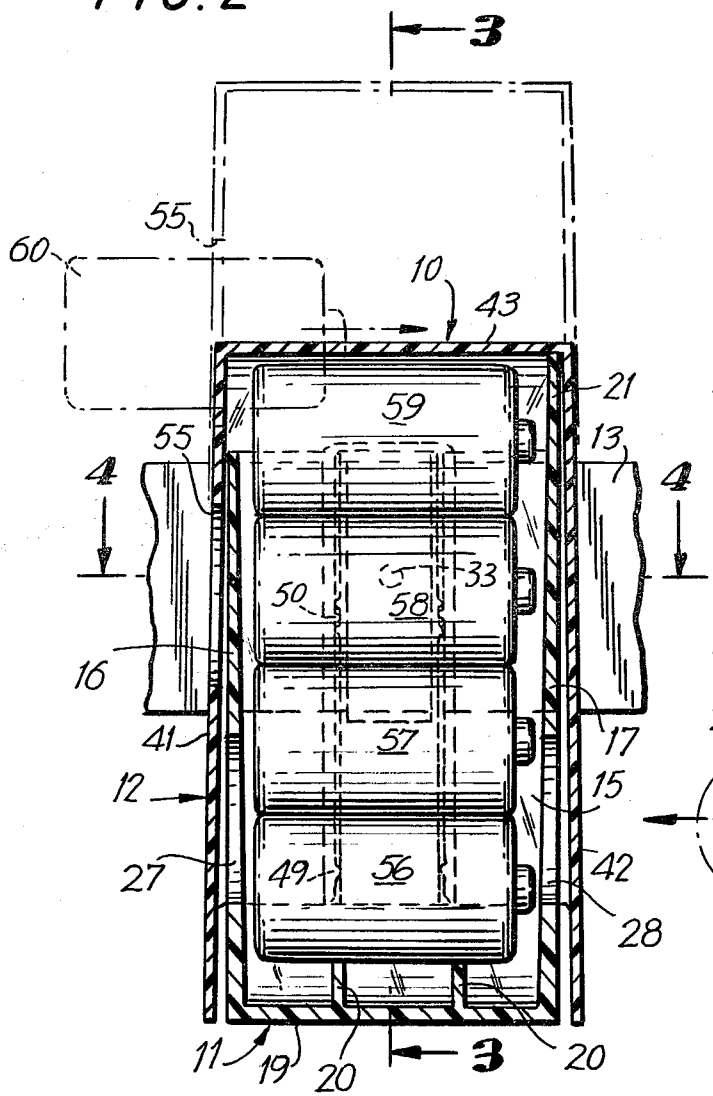
FIG. 2 is a sectional elevational view taken generally along the line 2—2 of FIG. 1, but showing the device in phantom in an open position receiving a film roll.
Figure 1:
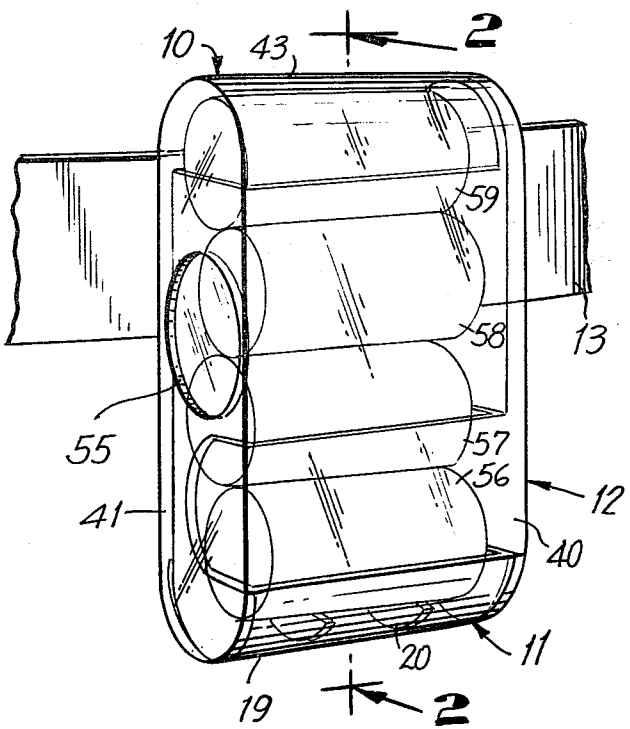
FIG. 1 is a front perspective view showing a film storage and dispensing device of the present invention in operative association with an article of user's apparel, and illustrated in the closed or storage condition.
Figure 4:
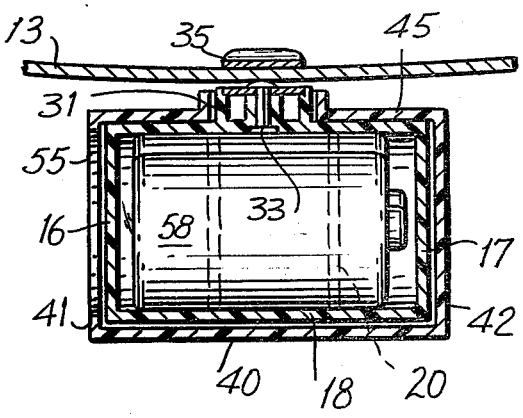
FIG. 4 is a horizontal sectional view taken generally along the line 4—4 of FIG. 2.

Referring now more particularly to the drawings, and specifically to FIGS. 1–3 thereof, the device of the present invention is there generally designated 10, and is illustreated in position as being mounted on a user's belt 13.

More specifically, the device or dispenser 10 may include a generally upright hollow inner body or magazine 11 and an outer body or cover 12 generally enclosing the magazine and shiftable vertically relative thereto.

The inner hollow body or magazine 11 may include a generally flat normally upright rear or back wall 15 say of generally rectangular configuration, and a pair of generally rectangular, parallel spaced side walls 16 and 17 extending forwardly from opposite sides of the back wall. A generally upright front wall 18 may extend laterally between forward regions of the side walls, and a lower or bottom wall 19 may extend between lower regions of the back, side and front walls. The bottom wall 19 may be upwardly concave, as illustrated, and may be provided with internal ribs 20 for supporting a lowermost film roll, as will appear presently.

One side wall 17 may upstand beyond the other side wall, in the form of a generally semi-circular extension 21, while the front and back walls 18 and 15 may terminate at their upper extremities generally flush with the other side wall 16. Thus, the upper end of the magazine 11 is open, defining an upper opening 22 facing upwardly, for a purpose to become presently apparent.

A lower region of front magazine wall 18, laterally entirely thereacross, is open, as at 25, at a location adjacent to and spaced above the lower wall 19 and supporting ribs 20. Thus, the lowermost region 26 of front wall 18 defines a lip upstanding from the bottom wall 19.

In addition, the lower opening 25 extends from its opposite lateral extremities rearwardly into respective side walls 16 and 17, as at 27 and 28, defining finger notches, as will appear more fully hereinafter.

Figure 7:
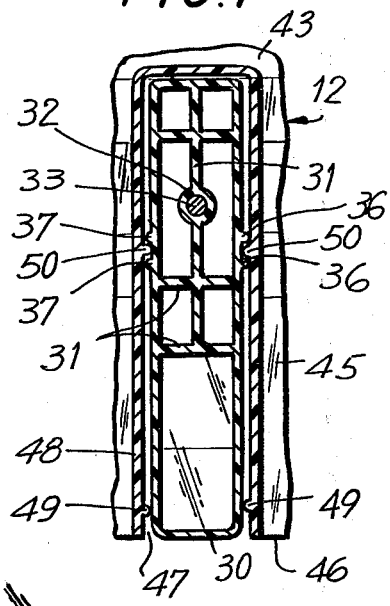
FIG. 7 is a partial sectional elevational view taken generally along the line 7—7 of FIG. 3.

Externally on the back wall 15, there may be provided an outstanding protrusion or boss 30, say in the form of a rib assuming the configuration of a vertically elongate closed outline of a rectangle, and having therein a grid work of crossing ribs 31, best seen in FIG. 7. Generally centrally of the grid-like ribs 31, there is provided a boss 32. A fastener 33 may extend through and be anchored in the boss 32, and secure thereto a mounting element or clip 35. That is, a generally U-shaped clip 35 may have one leg secured fast against the grid work ribs 31, as by fastener 33, for extension of the clip over and about a belt 13, as best seen in FIG. 3.

In addition, the protrusion 30 may be provided on opposite sides thereof with pairs of spaced nubs or tits, as at 36 on one side and 37 on the other side.

The entire inner hollow body or magazine 11, except for the mounting clip 35 and fastener 33, may advantageously be integrally fabricated, say of plastic, as by injection molding or other suitable mass production means. Also, the magazine may be of a light permeable material for visual access therethrough, but preferably of smoked or selective light resistant material to protect the contained film.

Considering now the outer hollow body, cover or sheath 12, which may also be advantageously integrally fabricated of suitable light permeable, but protectively smoked plastic, the cover may include a generally rectangular front wall 40 normally disposed in front of and covering the front magazine wall 18 and its lower opening 25, as best seen in solid lines in FIG. 3. A pair of parallel spaced side walls 41 and 42 extend rearwardly from opposite sides of front wall 40, adjacent to and outwardly of respective magazine side walls 16 and 17. A top wall may extend rearwardly from the upper region of front wall 40, as at 43, between the upper regions of side walls 41 and 42. As best seen in FIG. 3, the top wall 43 may be of internally concave, arcuate configuration, of generally inverted U-shape.

A rear cover wall is disposed rearwardly or outwardly of and adjacent to the rear magazine wall 15, as at 45, extending downwardly from the rear region of top wall 43 and laterally between the rear regions of side walls 41 and 42. The back wall 45 terminates at its lower edge 46 approximately level with the lower edge of front cover wall 40, while the cover side walls 41 and 42 may depend below the cover front and back walls, if desired.

Laterally spaced medially between the cover side walls 41 and 42, the cover back wall 45 is formed with a cutout or notch 47, of generally rectangular configuration extending upwardly approximate to the cover top wall 43 and opening downwardly. The cutout or notch 47 is sized and located for conforming reception therein of the back wall protrusion 30 of the magazine 11 (see FIG. 7). Bounding the cutout 47, the cover back wall 45 is formed integrally with an edge flange, lip or rib 48. Internally of the bounding flange 48, at upper and lower locations, there are provided opposed pairs of tits or nubs, a lower pair being designated 49 and an upper pair being designated 50. The nubs 49 and 50 are sized to engage between respectively adjacent pairs of tits or nubs 36 and 37. Further, by reason of the cutout or notch 47, the back cover wall 45 is afforded a relatively high degree of resilience or resilient spreadability. It is by this resilience that the opposed pairs of lower nubs 49 and upper nubs 50 are snap engagable into the spaces between the adjacent pairs of nubs 36 and 37.

That is, as shown in FIG. 7 the cover 12 is in its lower, down or closed position with the upper nubs 50 interengaged with the nub pairs 36 and 37. However, the cover 12 is shiftable vertically to an upper position, as shown in phantom in FIG. 2, at which position the lower nubs 49 will be raised into interengaging relation with respect to the nub pairs 36 and 37.

Figure 5:
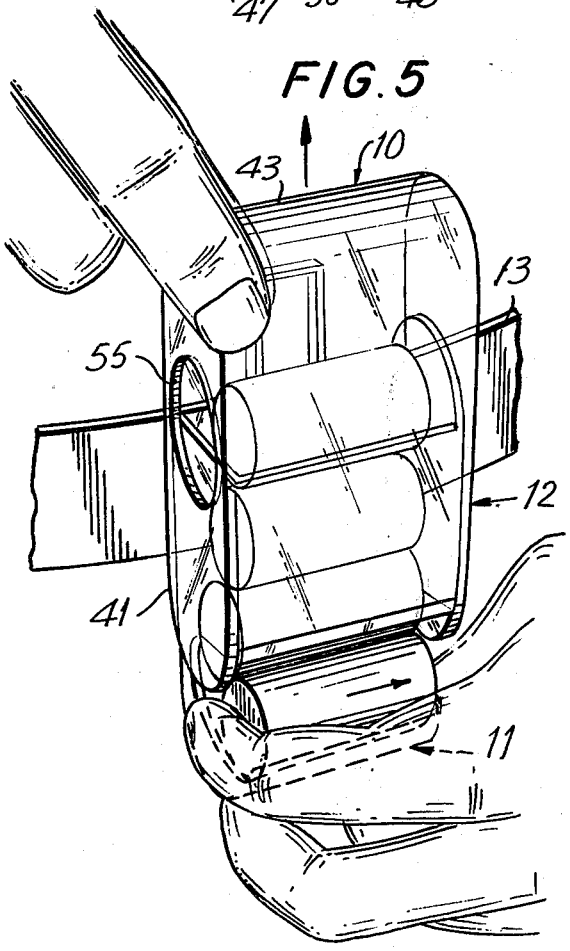
FIG. 5 is a front perspective view illustrating the open dispensing operative condition of the instant device.
Figure 6:
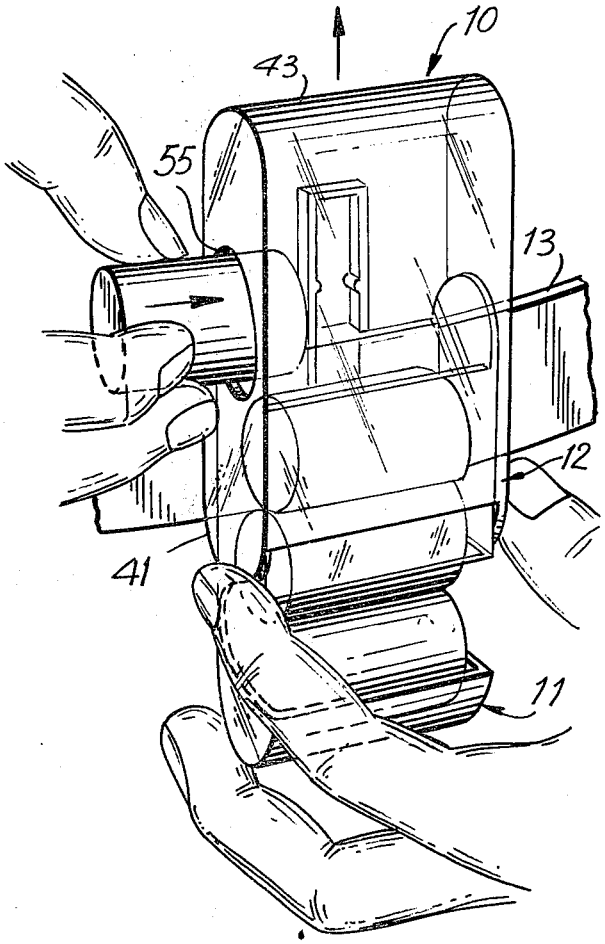
FIG. 6 is a front perspective view illustrating the device in its open position and showing a film roll being inserted.

In addition, one side wall of the outer hollow body or cover 12, say side wall 41, is provided with a through opening or hole 55 sized for the endwise passage therethrough of a film roll or cartridge. As best seen in FIGS. 2 and 3, in the closed, lowered position of cover 12, the internal vertical space between the lower or bottom wall 19 and its ribs 20 of the magazine and the upper or top wall 43 of the cover 12 is such as to receive and contain a number of rolls or cartridges, such as the rolls or cartridges 56,57, 58, and 59, reading from bottom to top, in the dispensing device 10. Further, the internal vertical space within the storing and dispensing device is insufficient to permit upward movement of the lowermost roll 56 when the cover is in its downward closed position sufficient to remove a roll through the lower opening 25. Also, the inlet opening 55 through one side wall 41 of the cover 12 is located so as to be closed or covered by the adjacent side wall 16 of the magazine 11 when the cover is closed. However, when the cover 12 is raised to its upward, open position, as shown in phantom in FIG. 2, the opening 55 is located above the upper edge adjacent magazine side wall 16, so as to be open and afford access therethrough for feeding or inserting a film roll 60 laterally inwardly and thence downwardly to assume the uppermost position of roll 59. Also, with the cover 12 raised to its open position, the extreme upward position shown in phantom in FIG. 3, the cover front wall 40 is raised to a position opening the lower front wall opening 25 of the magazine and permitting withdrawal therethrough of a lowermost film roll 56. Specifically, with the cover 12 raised to its open position, it is only then possible to raise the stack of rolls 56–59 sufficiently to locate lowermost roll 56 in alignment with lower outlet opening 25 for removal therethrough. Removal of the lowermost film roll 56 is facilitated by placement of the user's fingers laterally inwardly through respective cutouts or notches 27 and 28, to grasp and withdraw forwardly the lowermost roll, as best seen in FIG. 5. FIG. 6 indicates the insertion of a film roll laterally inwardly through cover opening 55 to assume the uppermost position of the stack.

From the foregoing, it will be seen that the device of the present invention provides a film storage and dispensing appliance which is extremely simple in construction and operation, foolproof and reliable in use, and which otherwise fully accomplishes its intended objects. It should be evident that while the present invention has been described as a storage device for film it can also be used to store other similarly shaped objects such as batteries or the like.

Although the present invention has been described in some detail by way of illustration and example for purposes of clarity of understanding, it is understood that certain changes and modifications may be made within the spirit of the invention.

What is claimed is:

1. Storage and dispensing device for film cartridges or the like comprising an upright magazine for containing a stack of film rolls, said magazine having an upper opening for receiving an uppermost roll and having a lower opening for discharging a lowermost roll, and a cover mounted externally on said magazine for up and down sliding movement between respective open and closed positions to selectively provide access to and block said upper and lower openings, an external protrusion on said magazine, said cover having a cutout opening downardly and slidably receiving therethrough said protrusion on said cover movement, and snap engageable interfitting formations on said protrusion and cover for releasably retaining the latter in said positions, and mounting means carried by said protrusion for mounting said magazine to a person.

2. Storage and dispensing device according to claim 1, said mounting means comprising a clip.

3. Storage and dispensing device according to claim 1, said lower opening facing generally horizontally for removal therethrough of the lowermost film roll when said cover is raised to expose said lower opening.

4. Storage and dispensing device according to claim 1, said upper opening facing generally upwardly, said cover having a lateral opening positioned to be closed by said magazine when said cover is down and to be clear of said magazine when said cover is up for communication with said upper magazine opening to pass a film roll to be stored in said magazine.

5. Storage and dispensing device for film cartridges or the like comprising an upright magazine for containing a stack of film rolls, said magazine having an upper opening for receiving an uppermost roll and having a lower opening for discharging a lowermost roll, and a cover mounted externally on said magazine for up and down sliding movement between respective open and closed positions to selectively provide access to and block said upper and lower openings, said magazine comprising a back wall, a pair of laterally spaced side walls extending forwardly from said back wall, a bottom wall extending forwardly from said back wall between said side walls, and a front wall extending between forward regions of said bottom and side walls, said lower opening extending laterally entirely across said front wall for passing a film roll and into said side walls to provide finger holes for grasping a film roll passing through said front wall, an external protrusion on the back wall of said magazine, said cover having an elongate cutout opening downwardly and slidably receiving therethrough said protrusion on said cover movement and affording resilient spreadability to said cover on opposite sides of said protrusion, and snap engageable interfitting formations on said protrusion and said cover adjacent to said cutout for releasably retaining the cover in said up and down positions, and mounting means carried by said protrusion for mounting said magazine to a person.

6. Storage and dispensing device according to claim 5, said mounting means comprising a clip.

7. Storage and dispensing device according to claim 5, said lower opening facing generally horizontally for removal therethrough of the lowermost film roll when said cover is raised to expose said lower opening.

8. Storage and dispensing device according to claim 5, said upper opening facing generally upwardly, said cover having a lateral opening positioned to be closed by said magazine when said cover is down and to be clear of said magazine when said cover is up for communication with said upper magazine opening to pass a film roll to be stored in said magazine.

* * * * *